US007059291B2

(12) United States Patent
Ueno et al.

(10) Patent No.: US 7,059,291 B2
(45) Date of Patent: Jun. 13, 2006

(54) INTERNAL COMBUSTION ENGINE, AND INTEGRATED CAM BRACKET OF INTERNAL COMBUSTION ENGINE

(75) Inventors: Tarou Ueno, Yokohama (JP); Hajime Oota, Tochigi (JP)

(73) Assignees: Nissan Motor Co., Ltd., Yokohama (JP); RENAULT s.a.s. societe par actions simplifiee, Boulogne-Billancourt (FR)

( * ) Notice: Subject to any disclaimer, the term of this patent is extended or adjusted under 35 U.S.C. 154(b) by 0 days.

(21) Appl. No.: 10/795,279

(22) Filed: Mar. 9, 2004

(65) Prior Publication Data

US 2004/0182354 A1 Sep. 23, 2004

(30) Foreign Application Priority Data

Mar. 20, 2003 (JP) ..... 2003-076801

(51) Int. Cl.
*F02F 7/00* (2006.01)
*B21D 51/30* (2006.01)

(52) U.S. Cl. ..... 123/193.5

(58) Field of Classification Search ..... 123/195 R, 123/193.5, 90.27, 90.38, 90.6, 90.33, 90.34
See application file for complete search history.

(56) References Cited

U.S. PATENT DOCUMENTS 4,823,747 A 4/1989 Wagner et al.
5,080,057 A 1/1992 Batzill et al.
5,913,293 A * 6/1999 Ochiai ..... 123/90.33
6,295,963 B1 * 10/2001 Kollock et al. ..... 123/193.5
6,513,474 B1 * 2/2003 Yoon ..... 123/90.27

FOREIGN PATENT DOCUMENTS

| | | | |
|---|---|---|---|
| DE | 39 43 727 | A1 | 2/1994 |
| DE | 100 18 063 | A1 | 10/2001 |
| JP | 62-131956 | A | 6/1987 |
| JP | 01-110815 | A | 4/1989 |
| JP | 5-86832 | A | 4/1993 |
| JP | 6-317110 | A | 11/1994 |
| JP | 8-246952 | A | 9/1996 |

* cited by examiner

*Primary Examiner*—Henry C. Yuen
*Assistant Examiner*—Hyder Ali
(74) *Attorney, Agent, or Firm*—Foley & Lardner LLP

(57) ABSTRACT

An internal combustion engine, includes: a cylinder head including; a bearing holder; and an integrated cam bracket held to the cylinder head, in a manner that a first cam shaft and a second cam shaft in parallel with each other in a direction of a line of a cylinder are sandwiched between the cylinder head and the integrated cam bracket. The integrated cam bracket includes; a first side frame and a second side frame, bearing beams bridging across the first side frame and the second side frame, the first cam shaft and the second cam shaft being rotatably born by the bearing beams with the bearing holder, a center beam disposed between the first side frame and the second side frame and extending in parallel with the first side frame and the second side frame, and a void portion collinear with the center beam and free from the center beam.

19 Claims, 3 Drawing Sheets

INTERNAL COMBUSTION ENGINE, AND INTEGRATED CAM BRACKET OF INTERNAL COMBUSTION ENGINE

BACKGROUND OF THE INVENTION

1. Field of the Invention

The present invention relates to an internal combustion engine. Especially, the present invention relates to an improvement of an integrated cam bracket (of the internal combustion engine) bearing two rotatable cam shafts.

2. Description of the Related Art

A general DOHC (=Double Over Head Cam shaft) type internal combustion engine has the following constitution. Above a cylinder head, there are provided two cam shafts for driving an intake valve and an exhaust valve. The two cam shafts are rotatably born by means of a plurality of cam brackets. Each of the cam brackets is secured to the cylinder head with a pair of bolts. The above constitution using the plurality of the cam brackets may have a great number of component parts and thereby complicate assembly.

Japanese Patent Unexamined Publication No. Heisei 6(1994)-317110 (=JP6317110) discloses an integrated cam bracket {rocker shaft cap} having a ladder frame constitution in which a plurality of bearing beams {cap parts} bridge across two side frames {beam parts}. A cam shaft is rotatably born with the plurality of the bearing beams {cap parts}.

BRIEF SUMMARY OF THE INVENTION

It is an object of the present invention to provide an internal combustion engine and an integrated cam bracket of the internal combustion engine which can effectively bring about secured rigidity as well as improved workability.

According to a first aspect of the present invention, there is provided an internal combustion engine, comprising: 1) a cylinder head and 2) an integrated cam bracket. Cylinder head includes; a bearing holder. Integrated cam bracket is held to an upper portion of the cylinder head, in such a manner that a first cam shaft and a second cam shaft extending substantially in parallel with each other in a direction of a line of a cylinder are sandwiched between the cylinder head and the integrated cam bracket. The integrated cam bracket includes;

i) a pair of a first side frame and a second side frame, ii) a plurality of bearing beams bridging across the first side frame and the second side frame, the first cam shaft and the second cam shaft being rotatably born by the bearing beams in cooperation with the bearing holder of the cylinder head, iii) a center beam disposed between the first side frame and the second side frame and extending substantially in parallel with the first side frame and the second side frame, and iv) a void portion defined substantially collinear with the center beam and being free from the center beam.

According to a second aspect of the present invention, there is provided an integrated cam bracket held to an upper portion of a cylinder head of an internal combustion engine, in such a manner that a first cam shaft and a second cam shaft extending substantially in parallel with each other in a direction of a line of a cylinder are sandwiched between the cylinder head and the integrated cam bracket. The integrated cam bracket comprises:

i) a pair of a first side frame and a second side frame, ii) a plurality of bearing beams bridging across the first side frame and the second side frame, the first cam shaft and the second cam shaft being rotatably born by the bearing beams in cooperation with a bearing holder of the cylinder head, iii) a center beam disposed between the first side frame and the second side frame and extending substantially in parallel with the first side frame and the second side frame, and iv) a void portion defined substantially collinear with the center beam and being free from the center beam.

The other object(s) and feature(s) of the present invention will become understood from the following description with reference to the accompanying drawings.

DETAILED DESCRIPTION OF THE EMBODIMENT

In the following, an embodiment of the present invention will be described in detail with reference to the accompanying drawings.

For ease of understanding, the following description will contain various directional terms, such as, left, right, upper, lower, forward, rearward and the like. However, such terms are to be understood with respect to only a drawing or drawings on which the corresponding part of element is illustrated.

For convenience sake, some members disclosed in the following embodiment have, as the case may be, a suffix "F" denoting first and a suffix "S" denoting second. With this, each of the members is properly distinguished from its counterpart. Each of F and S is to be suffixed to a numeral following the member.

<Constitution>

Figure 1:
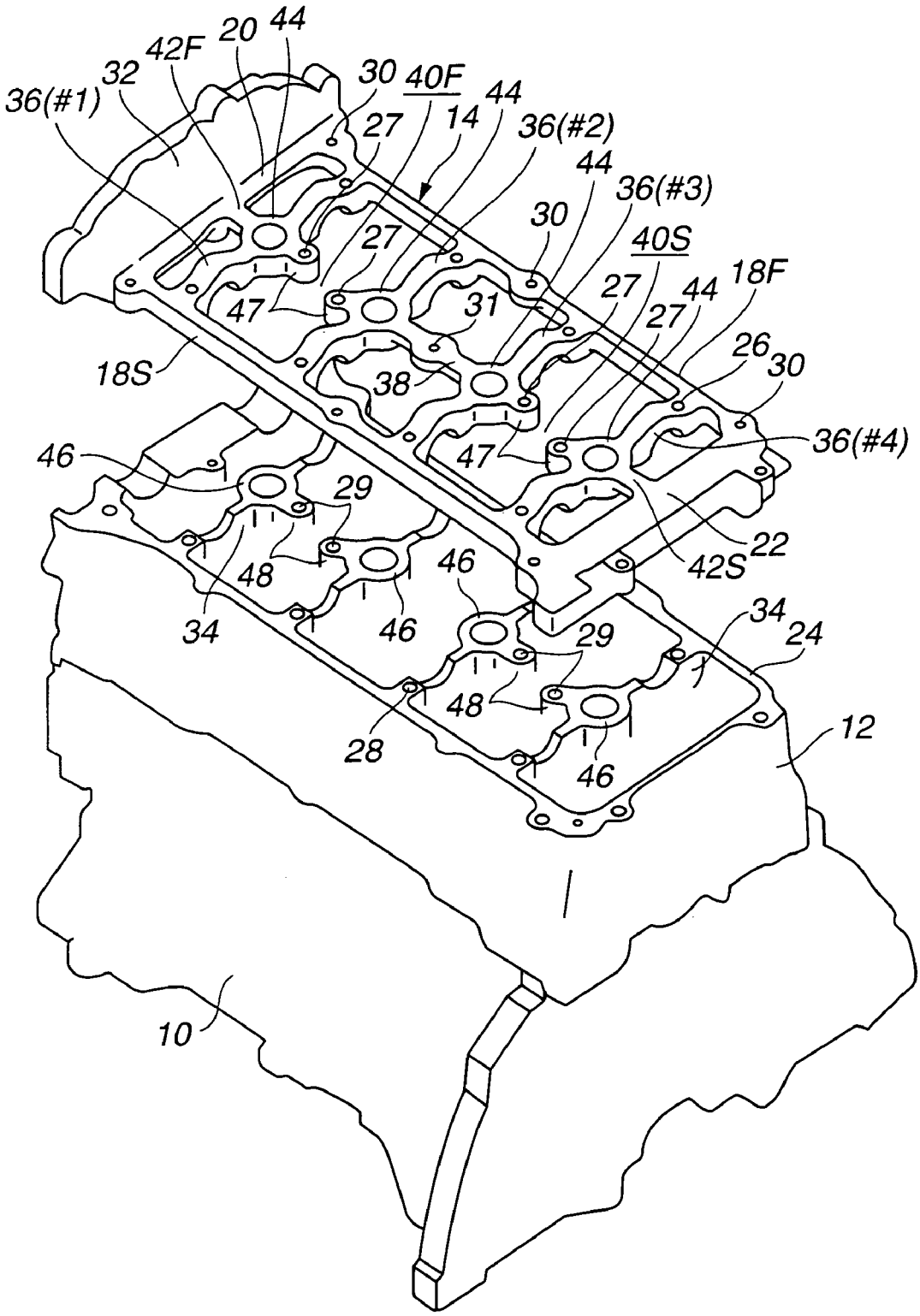
FIG. 1 is an exploded perspective view of an internal combustion engine (a rocker cover not shown), according to an embodiment of the present invention.
Figure 2:
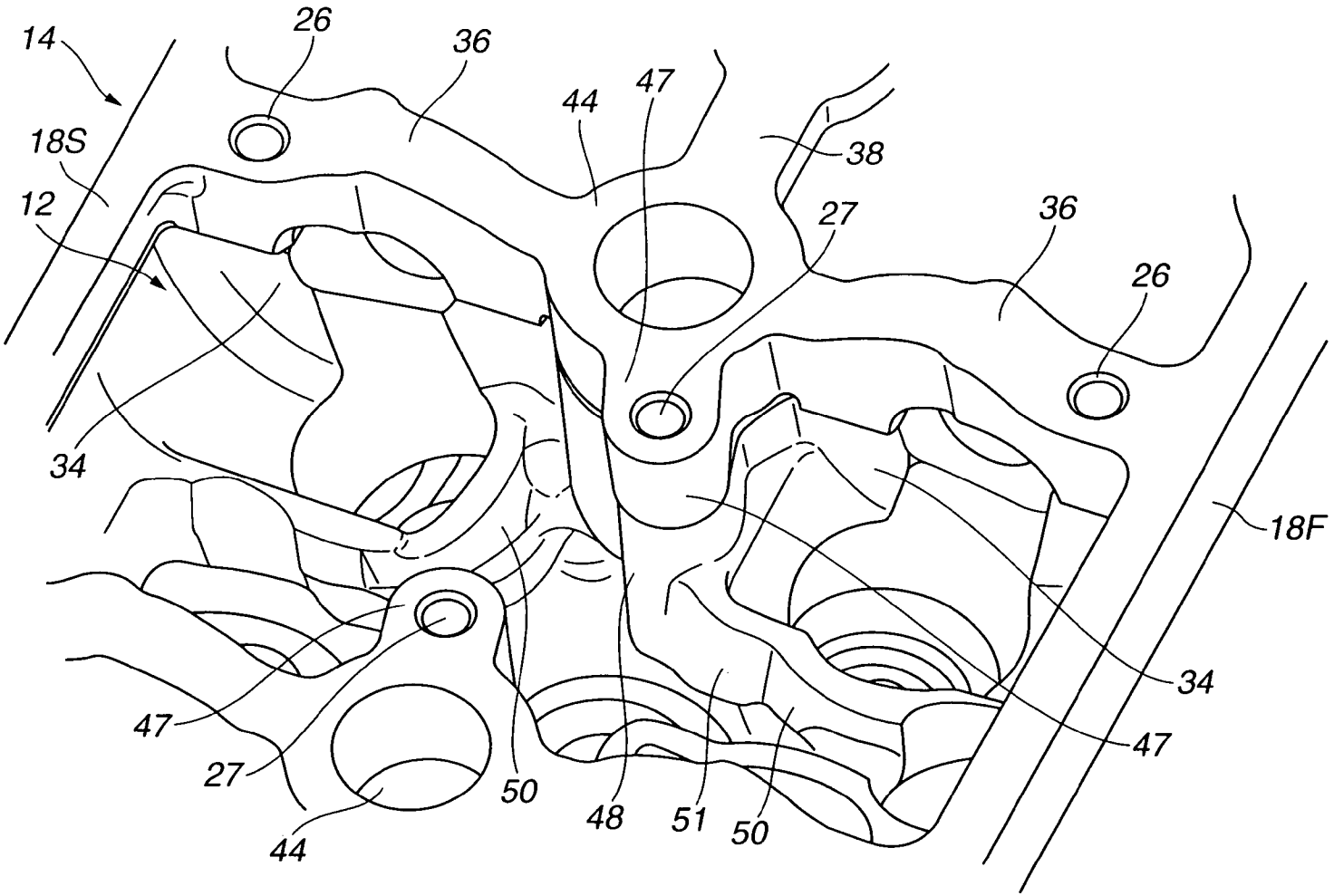
FIG. 2 is an enlarged perspective view of an essential part of the internal combustion engine, according to the embodiment of the present invention.
Figure 3:
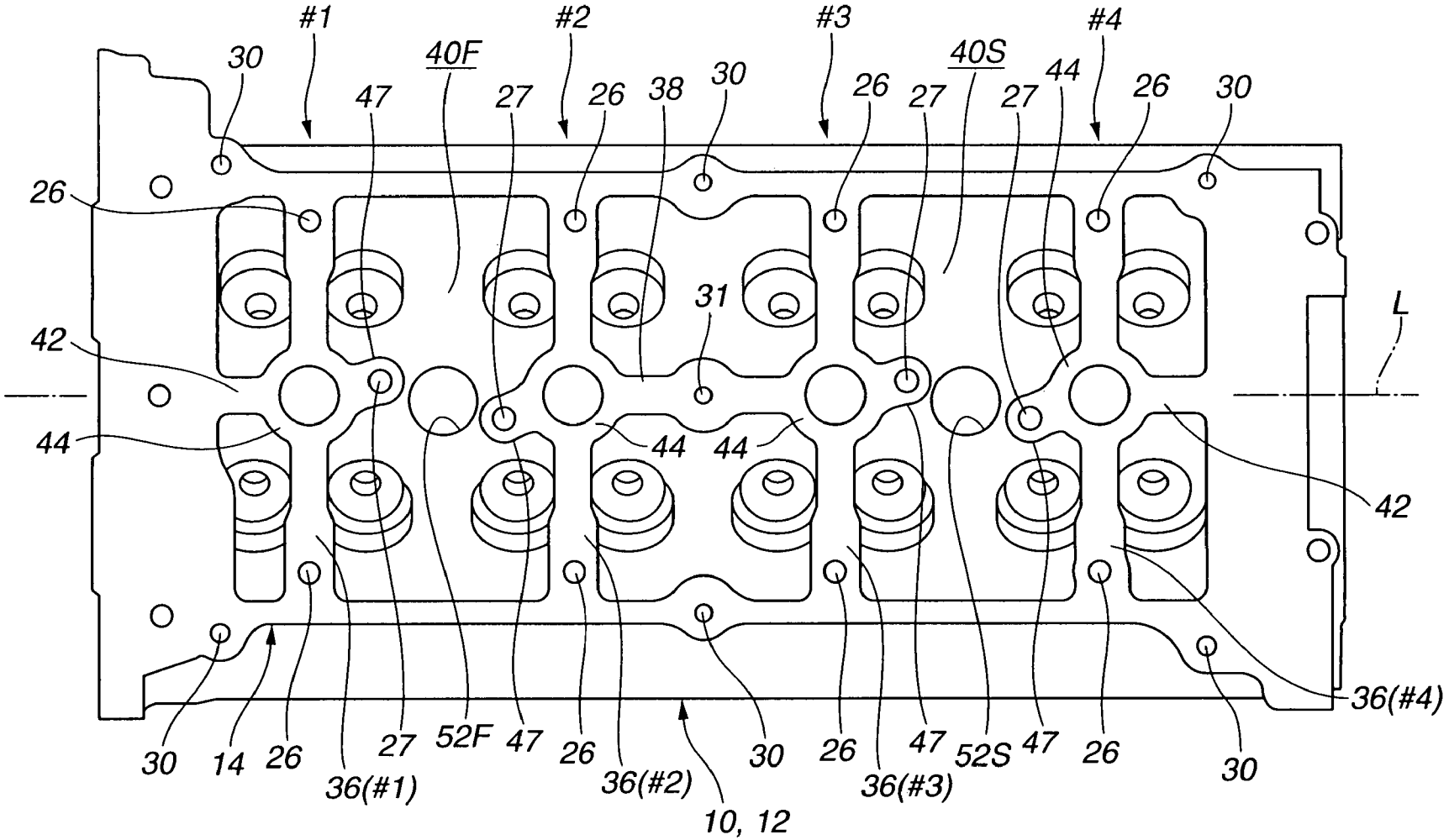
FIG. 3 is a top view of the internal combustion engine, according to the embodiment of the present invention.

FIG. 1 to FIG. 3 show an internal combustion engine to which an integrated cam bracket is applied, according to an embodiment of the present invention.

As is seen in FIG. 1, the internal combustion engine is of an in-line cylinder DOHC type, where DOHC stands for Double Over Head Cam shaft. The internal combustion engine in FIG. 1 is, on the whole, constituted of a cylinder block 10 and a cylinder head 12 which are made of an aluminum alloy and the like and integrated (cast) with each other. Cylinder head 12 has an upper portion to which an integrated cam bracket 14 (an essential part of the embodiment) is mounted. Between cylinder head 12 and integrated cam bracket 14, there are sandwiched two cam shafts (not shown) for driving an intake valve (not shown) and an exhaust valve (not shown). The cam shaft (not shown) are rotatably born.

Integrated cam bracket 14 is an integration of parts which are made of a metal including the aluminum alloy and the like. More specifically, integrated cam bracket 14 is formed with a first side frame 18F, a second side frame 18S, a front frame 20 (for connecting front ends of first side frame 18F and second side frame 18S), and a rear frame 22 (for connecting rear ends of first side frame 18F and second side frame 18S). First side frame 18F, second side frame 18S, front frame 20 and rear frame 22 constitute four sides, namely, an outer frame of integrated cam bracket 14, and are secured together by means of a plurality of a bracket securing bolts (not shown) to a flange face 24 which is formed on an upper periphery of cylinder head 12. Integrated cam bracket 14 is formed with a plurality of bolt holes 26 and a plurality of bolt holes 27 through which the bracket securing bolts (not shown) are inserted. Cylinder head 12 is formed with a bolt hole 28 and a bolt hole 29 for the above bracket securing bolts (not shown) to screw in.

Integrated cam bracket 14 has an upper portion to which a rocker cover (not shown) is bolted by means of a rocker cover bolt (not shown). Integrated cam bracket 14 is formed with a plurality of bolt holes including a bolt hole 30 and a bolt hole 31 for the rocker cover bolts (not shown) to screw in. Front frame 20 is integrated with a side wall 32 acting as a front cover of the rocker cover (not shown). After an assembly of the internal combustion engine, integrated cam bracket 14 is to be sandwiched between rocker cover (not shown) and cylinder head 12.

Integrated cam bracket 14 is integrated with a plurality of bearing beams 36 and a center beam 38. Each of bearing beams 36 bridges across first side frame 18F and second side frame 18S. A bearing holder 34 is formed on cylinder head 12. The two cam shafts (not shown) are sandwiched between bearing beams 36 and bearing holder 34, in such a manner as to be rotatably born with bearing beams 36 and bearing holder 34. Substantially in the center between first side frame 18F and second side frame 18S, center beam 38 extends along first side frame 18F and second side frame 18S in such a manner as to bridge across two adjacent bearing beams 36. Center beam 38 extends substantially in a direction of a center line L (see FIG. 3) which is a line of cylinders (not shown). Integrated cam bracket 14 is formed with a first void portion 40F and a second void portion 40S each of which is a space defined substantially collinear with center beam 38 and is free from center beam 38. In other words, each of first void portion 40F and second void portion 40S is so formed as to cut out a part of center beam 38.

Bearing beams 36 include a first cylinder bearing beam 36(#1), a second cylinder bearing beam 36(#2), a third cylinder bearing beam 36(#3) and a fourth cylinder bearing bema 36(#4). Bearing beams 36 are respectively disposed substantially above the four cylinders (not shown) substantially equidistantly. Each of bearing beams 36 runs across substantially a center portion of one of the cylinders (not shown). Center beam 38 is disposed substantially in the center of the line of the cylinders (not shown), in such a manner as to bridge across second cylinder bearing beam 36(#2) and adjacent third cylinder bearing beam 36(#3). First void portion 40F is defined on a first side of center beam 38, namely, between first cylinder bearing beam 36(#1) and adjacent second cylinder bearing beam 36(#2). Likewise, second void portion 40S is defined on a second side of center beam 38, namely, between third cylinder bearing beam 36(#3) and fourth cylinder bearing beam 36(#4). In sum, first void portion 40F, center beam 38 and second void portion 40S are disposed alternately per the cylinder (not shown), to thereby substantially equalize a rigidity and a seal face pressure in the direction of the line of the cylinders (not show), Moreover, first void portion 40F, center beam 38 and second void portion 40S are disposed substantially symmetrically with respect to bolt hole 31 which is defined substantially in the center of an area between second cylinder bearing beam 36(#2) and third cylinder bearing beam 36(#3), as is seen in FIG. 1.

Moreover, for improved rigidity and sealability, integrated cam bracket 14 is integrated with a first sub-center beam 42F bridging across front frame 20 and first cylinder bearing beam 36(#1), and is integrated with a second sub-center beam 42S bridging across rear frame 22 and fourth cylinder bearing beam 36(#4).

A connection for allowing an intersection and a connection of center beam 38 with bearing beam 36 is disposed substantially in a center of each of the cylinders (not shown). Likewise, a connection for allowing an intersection and a connection of sub-center beam 42 with bearing beam 36 is disposed substantially in a center of each of the cylinders (not shown). In the above connections on integrated cam bracket 14's side, there is formed a spark plug boss 44 for inserting therein a spark plug (not shown) facing substantially a center of a combustion chamber of the internal combustion engine. Corresponding to spark plug boss 44 on integrated cam bracket 14's side, cylinder head 12 is formed with a spark plug boss 46 for inserting therein the spark plug (not shown).

Spark plug boss 44 is disposed at an end portion (of center beam 38) facing void portion 40 and an end portion (of sub-center beam 42) facing void portion 40. Each of spark plug bosses 44 is integrated with a bolt boss 47 embossed toward void portion 40. Corresponding to bolt boss 47, spark plug boss 46 is integrated with a bolt boss 48. Bolt boss 47 is formed with a bolt hole 27 for inserting therein a bolt for bolting integrated cam bracket 14, while bolt boss 48 is formed with the bolt hole 29 for inserting therein a bolt for bolting integrated cam bracket 14.

As is seen in FIG. 3, two of bolt bosses 47 facing each other in such a manner as to define therebetween void portion 40 are offset oppositely from each other with respect to a longitudinal direction of center beam 38 extending substantially along center line L of the line of the cylinders (not shown). In other words, with respect to the longitudinal direction (center line L) of center beam 38, two bolt bosses 47 on integrated cam bracket 14's side are embossed in such a manner as to oppose each other with an inclination.

Likewise, with respect to the longitudinal direction (center line L) of center beam 38, two bolt bosses 48 on cylinder head 12's side are embossed in such a manner as to oppose each other with an inclination.

Cylinder head 12 is provided with a pair of the intake valve (not shown) and the exhaust valve (not shown) per cylinder (not shown). Moreover, as is seen in FIG. 2, cylinder head 12 is provided with a side wall 50 for guiding a valve lifter (not shown) of each of the intake valve (not shown) and the exhaust valve (not shown). As is seen in FIG. 2, one of valve lifters 50 is integrally connected with bolt boss 48. In connection with this, a side wall extension 51 extending continuously from valve lifter 50 is provided for connecting to bolt boss 48. As described above, two of bolt bosses 48 are offset oppositely from each other with respect to the longitudinal line (center line L) of center beam 38, thereby disposing bolt boss 48 close to side wall 50, resulting in facilitated connection of bolt boss 48 with side wall 50.

As is seen in FIG. 3, cylinder head 12 defines a pair of a first core hole 52F and a second core hole 52S for extracting a core sand. First core hole 52F is defined between first cylinder bearing beam 36(#1) and second cylinder bearing beam 36(#2), while second core hole 52S is defined between third cylinder bearing beam 36(#3) and fourth cylinder bearing beam 36(#4). First void portion 40F is formed corresponding to first core hole 52F, while second void portion 40S is formed corresponding to second core hole 52S.

Void portion 40 is formed in such a manner as to define an open space above core hole 52, thereby a blind plug (not shown) can be inserted into core hole 52 in a state that integrated cam bracket 14 is assembled.

With two bolt bosses 47 offset oppositely from each other with respect to the longitudinal direction (center line L) and two bolt bosses 48 offset oppositely from each other with respect to the longitudinal direction (center line L), as described above, the open space can be secured for void portion 40, thus opening extensively an upper portion of core hole 52.

<Operation>

Described hereinafter is operation of the internal combustion engine and integrated cam bracket 14 of the internal combustion engine, according to the embodiment of the present invention.

(1) Integrated cam bracket 14 constituting a ladder frame includes:

side frame 18, front frame 20 and rear frame 22 which three constituting the outer frame, and bearing beam 36 bridging across first side frame 18F and second side frame 18S, center beam 38 bridging across two adjacent bearing beams 36, first sub-center beam 42F bridging across bearing beam 36 and front frame 20, and second sub-center beam 42S bridging across bearing beam 36 and rear frame 22.

In integrated cam bracket 14 above, center beam 38 is provided which extends substantially along first side frame 18F and second side frame 18S and bridges across adjacent bearing beams 36 {namely, second cylinder bearing beam 36(#2) and third cylinder bearing beam 36(#3)}.

With the above constitution, integrated cam bracket 14 can effectively bring about secured rigidity substantially in the center in the widthwise direction of the internal combustion engine (not shown), namely, in an upper and lower direction {in a direction of the intake valve (not shown) and the exhaust valve (not shown)} in FIG. 3.

In addition, defining void portion 40 substantially collinear with center beam 38 can improve workability including machining and assembling of the internal combustion engine (not shown).

For example, assembling of the internal combustion engine can be improved in the following manner:

For holding the cam shaft (not shown) in a certain rotary position by means of a tool (not shown) in a state that integrated cam bracket 14 is assembled to the upper portion of cylinder head 12, so as to hold a chain sprocket (not shown) and to position the cam shaft (not shown), void portion 40 and a surrounding space thereof can be used for a convenient handling of the tool (not shown), resulting in improved workability.

In sum, integrated cam bracket 14 having the above constitution can improve rigidity (holding), without deteriorating the workability.

(2) Spark plug boss 44 positioned at the end portion of center beam 38 and the end portion of sub-center beam 42 is formed with bolt boss 47. Integrated cam bracket 14 is held to cylinder head 12 in the above position (namely, bolt boss 47), thereby securing the seal face pressure around the spark plug (not shown) which is disposed substantially in the widthwise center (where high seal face pressure preferred) of cylinder head 12.

(3) In assembling the engine, the following operation is to be taken:

With integrated cam bracket 14 assembled to cylinder head 12, a cam journal hole (not shown) is machined that is to be formed in bearing beam 36, bearing holder 34 and the like.

Then, a final washing is to be carried out for removing chips.

For securing the final washing, mounting the blind plug (not shown) to core hole 52 is to be carried out after the final washing. In view of a possible deformation due to the mounting of the blind plug (not shown), measuring of the cam journal hole (not shown) is to be carried out after the mounting of the blind plug (not shown).

According to the embodiment of the present invention, void portion 40 is formed corresponding to core hole 52. With integrated cam bracket 14 assembled to cylinder head 12, the blind plug (not shown) can be mounted to core hole 52. Thereby, the serial operations described above can be done without dismounting integrated cam bracket 14, thus improving the workability.

(4) First void portion 40F, center beam 38 and second void portion 40S are disposed substantially symmetrical with respect to the center in the direction of the line of the cylinders (not shown), thereby reducing and avoiding possible variation of the rigidity and the seal face pressure in the direction of the cylinders (not shown).

(5) With center beam 38 formed substantially in the center of the line of the cylinders (not shown) and with substantially the center portion of center beam 38 formed with bolt hole 31 for holding the rocker cover (not shown), the seal face pressure between rocker cover (not shown) and integrated cam bracket 14 can be substantially equalized properly.

(6) Bolt boss 47 (a position for holding integrated cam bracket 14 to cylinder head 12) disposed at the end portion (of center beam 38) facing void portion 40 and at the end portion (of sub-center beam 42) facing void portion 40 can compensate for a possible reduced rigidity which may be caused by defining void portion 40 and can properly secure the seal face pressure of the mating face between integrated cam bracket 14 and cylinder head 12.

(7) Two bolt bosses 47 facing on respective sides of void portion 40 are offset oppositely from each other in directions different from each other, thus improving the workability of mounting the blind plug (not shown) and the workability of inserting the tool (not shown) for holding the cam shaft (not shown) and improving balancing of holding integrated cam bracket 14.

(8) Connecting bolt boss 48 to side wall 50 (see FIG. 2) for allowing side wall 50 to be usable for mounting bolt boss 48 can restrict increased weight due to bolt boss 48. In the case of forming a bolt boss in a position away from side wall 50, the bolt boss is expected to uprise from an upper deck face of cylinder head 12, resulting in increased weight.

Although the present invention has been described above by reference to a certain embodiment, the present invention is not limited to the embodiment described above. Modifications and variations of the embodiment described above will occur to those skilled in the art, in light of the above teachings.

More specifically, according to the embodiment of the present invention described above, it is the in-line four-cylinder internal combustion engine to which the embodiment is applied. The present invention is, however, not limited to the above. A six-cylinder V-type internal combustion engine can replace the in-line four-cylinder internal combustion engine.

This application is based on a prior Japanese Patent Application No. P2003-076801 (filed on Mar. 20, 2003 in Japan). The entire contents of the Japanese Patent Application No. P2003-076801 from which priority is claimed is incorporated herein by reference, in order to take some protection against mis-translation or omitted portions.

The scope of the present invention is defined with reference to the following claims.

What is claimed is:

1. An internal combustion engine, comprising:

1) a cylinder head including;
a bearing holder; and 2) an integrated cam bracket held to an upper portion of the cylinder head, in such a manner that a first cam shaft and a second cam shaft extending substantially in parallel with each other in a direction of a line of a cylinder are sandwiched between the cylinder head and the integrated cam bracket, the integrated cam bracket including;

i) a pair of a first side frame and a second side frame, ii) a plurality of bearing beams bridging across the first side frame and the second side frame, the first cam shaft and the second cam shaft being rotatably born by the bearing beams in cooperation with the bearing holder of the cylinder head, iii) a center beam disposed between the first side frame and the second side frame and extending substantially in parallel with the first side frame and the second side frame, and iv) a void portion defined substantially collinear with the center beam and being free from the center beam, wherein the cylinder head is formed with a core hole for extracting a core sand, the core hole opening in an upper face of the cylinder head, and the void portion is so formed as to substantially correspond to the core hole.

2. An internal combustion engine, comprising:

1) a cylinder head including;
a bearing holder; and 2) an integrated cam bracket held to an upper portion of the cylinder head, in such a manner that a first cam shaft and a second cam shaft extending substantially in parallel with each other in a direction of a line of a cylinder are sandwiched between the cylinder head and the integrated cam bracket, the integrated cam bracket including;

i) a pair of a first side frame and a second side frame, ii) a plurality of bearing beams bridging across the first side frame and the second side frame, the first cam shaft and the second cam shaft being rotatably born by the bearing beams in cooperation with the bearing holder of the cylinder head, iii) a center beam disposed between the first side frame and the second side frame and extending substantially in parallel with the first side frame and the second side frame, and iv) a void portion defined substantially collinear with the center beam and being free from the center beam, wherein each of the bearing beams is disposed substantially above one of the cylinders, the center beam bridging across two of the bearing beams which are disposed adjacent to each other, the void portion is formed between two of the bearing beams which are disposed adjacent to each other, and the center beam and the void portion, wherein the void portion includes a first void portion and a second void portion, are alternately disposed substantially in the direction of the line of the cylinder.

3. The internal combustion engine as claimed in claim 2, wherein the first void portion, the center beam, and the second void portion are disposed substantially symmetrical with respect to a center in the direction of the line of the cylinder.

4. The internal combustion engine as claimed in claim 2, wherein the cylinder includes a first cylinder, a second cylinder, a third cylinder, and a fourth cylinder, the center beam is disposed between the second cylinder and the third cylinder, and the first void portion is disposed between the first cylinder and the second cylinder, while the second void portion is disposed between the third cylinder and the fourth cylinder.

5. The internal combustion engine as claimed in claim 2, further comprising a rocker cover which is mounted to an upper portion of the integrated cam bracket.

6. The internal combustion engine as claimed in claim 2, wherein the integrated cam bracket further includes a front frame and a rear frame for connecting an end portion of the first side frame to an end portion of the second side frame.

7. An internal combustion engine, comprising:

1) a cylinder head including;
a bearing holder; and 2) an integrated cam bracket held to an upper portion of the cylinder head, in such a manner that a first cam shaft and a second cam shaft extending substantially in parallel with each other in a direction of a line of a cylinder are sandwiched between the cylinder head and the integrated cam bracket, the integrated cam bracket including;

i) a pair of a first side frame and a second side frame, ii) a plurality of bearing beams bridging across the first side frame and the second side frame, the first cam shaft and the second cam shaft being rotatably born by the bearing beams in cooperation with the bearing holder of the cylinder head, iii) a center beam disposed between the first side frame and the second side frame and extending substantially in parallel with the first side frame and the second side frame, and iv) a void portion which is a hollow space extending substantially in parallel with the first side frame and the second side frame and which is arranged in a line with the center beam, wherein the integrated cam bracket is formed with a connecting member boss, the cylinder head is formed with a connecting member boss, a connecting member mates with the connecting member boss of the integrated cam bracket and with the connecting member boss of the cylinder head, thereby connecting the connecting member boss of the integrated cam bracket to the connecting member boss of the cylinder head, and the connecting member boss of the integrated cam bracket is embossed toward the void portion from an end portion of the center beam.

8. The internal combustion engine as claimed in claim 7, wherein on the integrated cam bracket's side:

a connection for connecting each of the bearing beams to the center beam is formed with a spark plug boss, and the spark plug boss is formed with the connecting member boss of the integrated cam bracket.

9. The internal combustion engine as claimed in claim 7, wherein a side wall surrounding a valve lifter is formed on the cylinder head, and the side wall connects to the connecting member boss of the cylinder head.

10. The internal combustion engine as claimed in claim 7, wherein two of the connecting member bosses of the integrated cam bracket facing each other in such a manner as to define therebetween the void portion are offset oppositely from each other with respect to a longitudinal direction of the center beam.

11. The internal combustion engine as claimed in claim 10, wherein two of the connecting member bosses of the cylinder head facing each other are offset oppositely from each other with respect to the longitudinal direction of the center beam.

12. The internal combustion engine as claimed in claim 7, wherein the connecting member boss of the integrated cam bracket is a bolt boss, the connecting member boss of the cylinder head is a bolt boss, and the connecting member mating with the bolt boss of the integrated cam bracket and with the bolt boss of the cylinder head is a bolt.

13. An internal combustion engine, comprising:

1) a cylinder head including bearing portions for supporting first and second camshafts both extending in a cylinder row direction of the engine; and 2) an integrated cam bracket fixed to the cylinder head, the integrated cam bracket comprising;

i) an outer frame including first and second sides extending longitudinally in the cylinder row direction;

ii) a plurality of bearing cross beams extending laterally from the first side to the second side of the outer frame, connecting the first and second sides of the outer frame, and supporting the first and second cam shafts with the bearing portions of the cylinder head, each of the cross beams including a middle portion between the first and second sides of the outer frame;

iii) a center beam extending in the cylinder row direction and connecting the middle portions of two of the bearing cross beams; and iv) a void portion extending in the cylinder row direction and spacing the middle portions of two of the bearing cross beams from each other.

14. The internal combustion engine as claimed in claim 13, wherein the engine includes a plurality of cylinders; wherein the cylinder head includes bolt bosses; and the middle portion of each of the bearing cross beams is located just above one of the cylinders of the engine, and includes a spark plug boss and a bolt boss joined with one of the bolt bosses of the cylinder head.

15. The internal combustion engine as claimed in claim 13, wherein the void portion extends between the first and second sides of the outer frame so that two of the bearing cross beams are spaced from one another.

16. An integrated cam bracket adapted to be fixed to a cylinder head of an internal combustion engine, and arranged to support first and second camshafts extending in a cylinder row direction along a row of cylinders of the engine, the integrated cam bracket comprising:

i) an outer frame including first and second sides both extending in a longitudinal direction which is aligned with the cylinder row direction in an assembled state in which the integrated cam bracket is fixed to the cylinder head;

ii) first, second and third bearing cross beams each extending laterally from the first side to the second side of the outer frame, thereby connecting the first and second sides of the outer frame, and including a first side portion for supporting the first cam shaft rotatably, a second side portion for supporting the second cam shaft rotatably, and a middle portion between the first and second side portions; and iii) a center beam extending in the longitudinal direction of the outer frame between the first and second sides of the outer frame and connecting the middle portions of the second and third bearing cross beams whereas the middle portions of the first and second bearing cross beams are spaced from each other by an interspace extending laterally between the first and second bearing cross beams.

17. The integrated cam bracket as claimed in claim 16, wherein the interspace extends laterally between the first and second bearing cross beams from the first side to the second side of the outer frame.

18. The integrated cam bracket as claimed in claim 16, wherein the integrated cam bracket further comprises a fourth cross beam extending laterally from the first side to the second side of the outer frame, thereby connecting the first and second sides of the outer frame, and including a first side portion for supporting the first cam shaft rotatably, a second side portion for supporting the second cam shaft rotatably, and a middle portion between the first and second side portions; and the middle portions of the third and fourth bearing cross beams are spaced from each other by an interspace extending laterally between the first and second bearing cross beams.

19. The integrated cam bracket as claimed in claim 16, wherein the outer frame of the integrated cam bracket is rectangular and further includes a front side connecting front ends of the first and second sides of the outer frame, and a rear side connecting rear ends of the first and second sides of the outer frame, and the integrated cam bracket further comprises a front end beam extending in the longitudinal direction and connecting a middle portion of the front side of the outer frame and the middle portion of one of the cross beams located adjacent to the front side of the outer frame, and a rear end beam extending in the longitudinal direction and connecting a middle portion of the rear side of the outer frame and the middle portion of one of the cross beams located adjacent to the rear side of the outer frame.

* * * * *